United States Patent [19]

Andreae

[11] 4,083,132

[45] Apr. 11, 1978

[54] DRAGHEAD FOR SUCTION DREDGER

[75] Inventor: Johannes Franciscus Reinardus Andreae, Gorinchem, Netherlands

[73] Assignee: Bos Kalis Westminster Group N.V., Sliedrecht, Netherlands

[21] Appl. No.: 696,363

[22] Filed: Jun. 15, 1976

[30] Foreign Application Priority Data

Jun. 30, 1975 Netherlands ..... 7507759

[51] Int. Cl.[2] ..... E02F 3/88

[52] U.S. Cl. ..... 37/58; 37/63

[58] Field of Search ..... 37/58, 61, 62, 63, 71, 37/195, DIG. 8, 55, 64, 67; 302/15, 58; 15/409

[56] References Cited

U.S. PATENT DOCUMENTS

| | | | |
|---|---|---|---|
| 724,501 | 4/1903 | Reno | 37/58 |
| 842,383 | 1/1907 | Clark | 37/61 |
| 887,506 | 5/1908 | Newcomb | 37/67 |
| 1,436,015 | 11/1922 | Cushing | 37/67 |
| 1,769,999 | 7/1930 | Johnson | 37/64 |
| 2,205,490 | 6/1940 | Peterson | 37/71 X |
| 3,226,854 | 1/1966 | Mero | 37/58 |
| 3,260,004 | 7/1966 | Brooks | 37/195 |

FOREIGN PATENT DOCUMENTS

| | | | |
|---|---|---|---|
| 558,230 | 12/1957 | Belgium | 37/58 |
| 187,020 | 7/1907 | Germany | 37/63 |
| 150,015 | 8/1920 | United Kingdom | 37/63 |
| 309,101 | 4/1929 | United Kingdom | 37/61 |
| 124,372 | 3/1959 | U.S.S.R. | 37/58 |
| 222,978 | 10/1968 | U.S.S.R. | 37/63 |

*Primary Examiner*—Clifford D. Crowder

*Attorney, Agent, or Firm*—Cushman, Darby & Cushman

[57] ABSTRACT

Method and a draghead to be used therein for sucking a slurry of earth and transport water by means of a trailing suction dredger, the draghead including at least one cutter for loosening the earth and water guiding means being provided to guide the transport water to the suction line in a powerful jet substantially parallel to and along the top edge of the cutter.

5 Claims, 6 Drawing Figures

DRAGHEAD FOR SUCTION DREDGER

The present invention relates to a method of loosening and sucking earth using a draghead comprising at least one cutter for loosening the earth and means for forming a slurry which can easily be sucked.

Originally there were two types of draghead as used by a trailing suction dredger for sucking earth from a sea, river or lake bottom. One type is primarily active with hydraulic forces, the earth being loosened and sucked by erosion. Such a type of draghead is particularly suitable for sucking sand. Indeed, steps have been proposed to prepare the earth somewhat by water jets and the like. The other draghead type is mainly active with mechanical means, such as one or more cutters. The use of cutters is desirable in more coherent earth like clay.

It has also been proposed to construct a draghead in such a manner that it is suitable for various types of earth without any conversion.

The object of the invention is to provide an improved method of the type defined above, and also an improved draghead with which this method can be carried out.

According to the application it is proposed to suck earth by means of a draghead with at least one cutter, while directing a powerful water jet substantially parallelly along the upper edge of the cutter. A draghead of the type defined above is to this end provided, according to the invention, with a water passage parallel to and following up the upper edge of the cutter, which water passage terminates into the suction line of the draghead. It has appeared that with such a method and such a draghead a considerably higher concentration of solid material in the sucked slurry is obtained.

Particularly the sucked water, which will act as transport water for the slurry, can be passed through the draghead with an optimally concentrated jet. In the conventional draghead with cutters, local water velocities in the order of 1 m per second may occur. In accordance with the present application the water jet is being so concentrated that substantially constant velocities in the order of 3–6 m/sec. of water and the slurry flow through the draghead are effectively active as far as in the suction line, so that lower water velocities are avoided and the chance of clogging of the draghead by settling is reduced.

The invention will now be elucidated in more detail with reference to the drawings showing some embodiments and further particulars by way of example.

Figure 2:
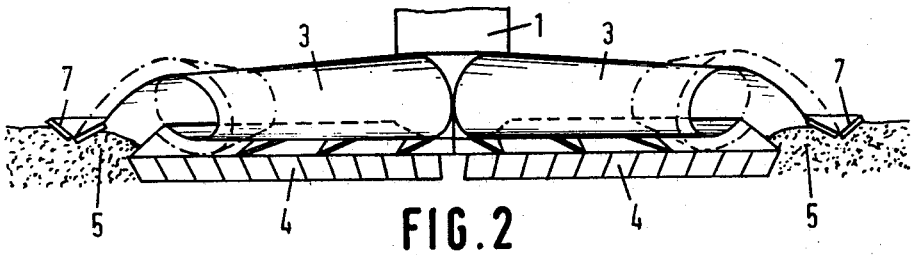
FIG. 2 is a rear view of the draghead shown in FIG. 1.
Figure 3:
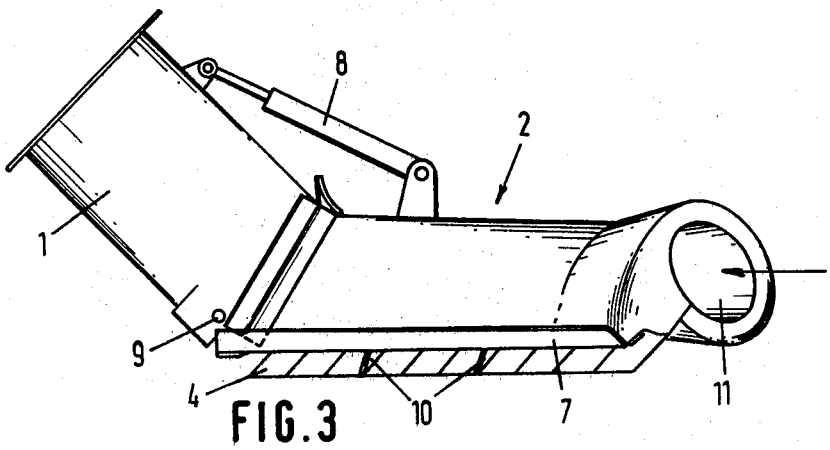
FIG. 3 is a side elevational view of the draghead shown in FIG. 1.
Figure 4:
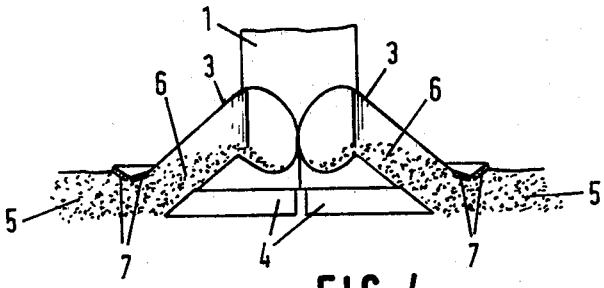
FIG. 4 is a vertical cross-sectional view of the draghead shown in FIG. 1.

The draghead shown in the drawings includes a connecting piece 1 for a connection with a suction tube of a trailing suction dredger. The head itself is generally indicated by 2 and includes two channels or trough-shaped supply tubes 3, through which water can flow in front of, above and/or behind the cutter generally indicated by 4. This cutter has a V-shape in bottom view, the point of which points in the drag direction, i.e. in the direction of movement of the draghead. The earth over which and in which the draghead is dragged is indicated by 5 (FIGS. 2 and 4), while by 6 (in FIG. 4) are indicated the earth cuts as loosened by cutter 4 and falling into the troughs or tubes 3. The draghead itself rests on the earth by means of shoes 7. These shoes are so constructed that during dredging substantially no surrounding water will be sucked from below the shoes, so that the water flow is supplied via tubes 3 in concentrated form. In FIG. 3, 8 is a hydraulic cylinder, with which the position of the draghead 2 can be adjusted with respect to the suction tube connection 1. To this end there is provided a hinge designated by 9 between draghead and suction tube. At the top of the cutter there is a number of guide vanes designated by 10. The entrance of the troughs or tubes is indicated by 11, the arrow indicating the direction of flow of the sucked water.

The surface of the cross-section of the suction tube connection 1 is substantially equal to the sum of the cross-sectional surface of the two tubes 3, so that a substantially constant flow rate will be obtained. As will appear more particularly from the vertical cross-sectional view of FIG. 4, the two legs of the V-shaped cutter 4 lift the earth in cuts 6 to enter the troughs 3. Under its own weight, depending on the cohesion of the earth, these cuts will crumble on the top edge of the cutter. Owing to the relatively high water velocities of 3 to 6 m/sec. maintained in channels 3, the earth parts in said channel erode and the slurry is formed. Owing to the flow parallel to the cutter, a relatively high concentration of earth particles in the transport water will be obtained adjacent the V-point.

Figure 5:
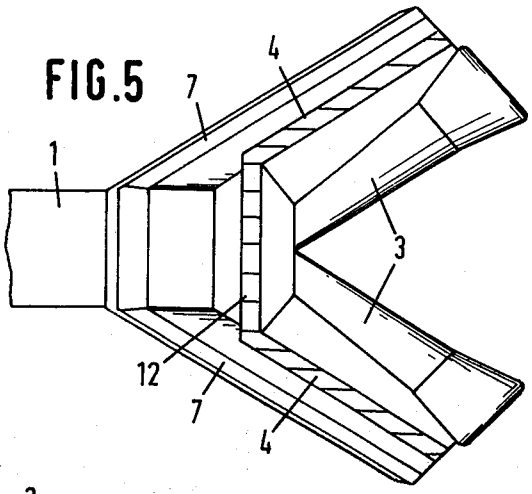
FIG. 5 is a schematic bottom view of a variant construction of a draghead.
Figure 1:
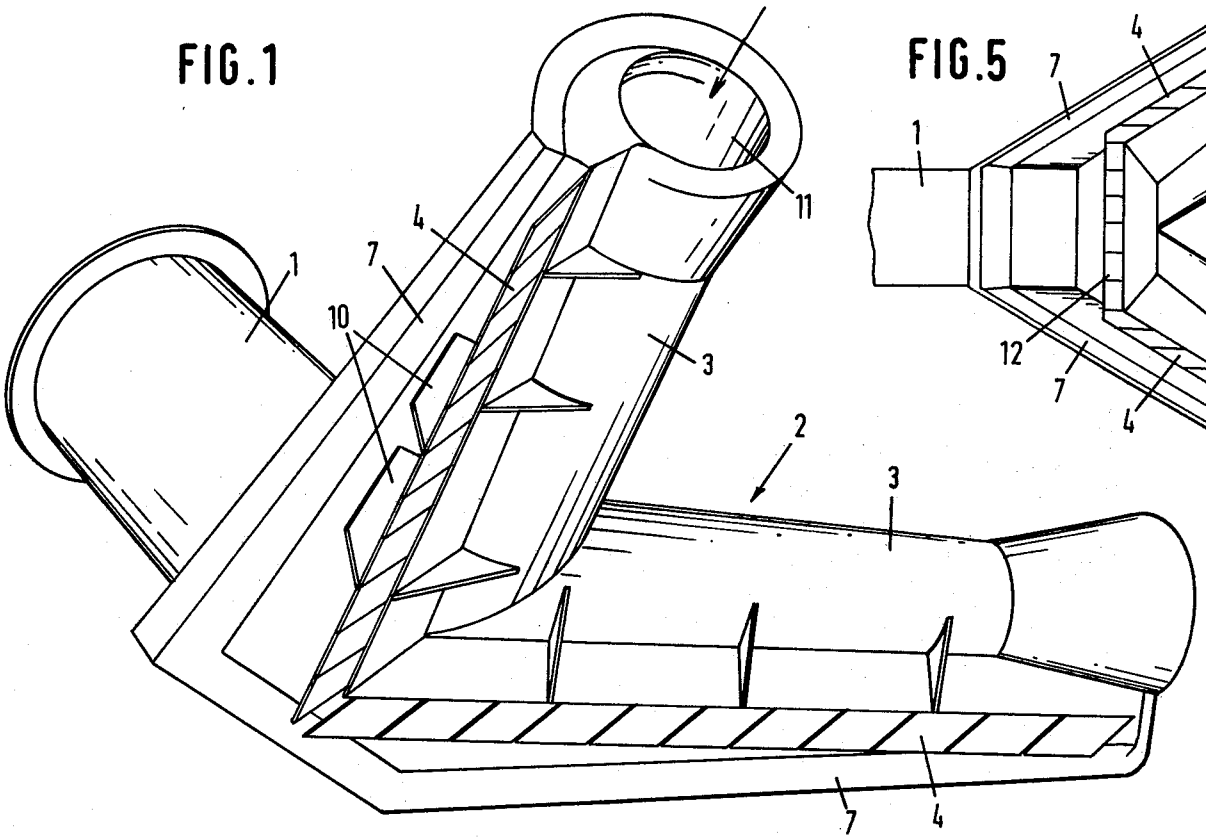
FIG. 1 shows schematically a perspective bottom view of a draghead according to the invention.

The embodiment shown in FIG. 5 differs from that shown in FIG. 1 in that therein the water tubes 3 are fully parallel to the legs of the V-shaped cutter 4, while moreover the cutter is provided with a truncated point 12.

Figure 6:
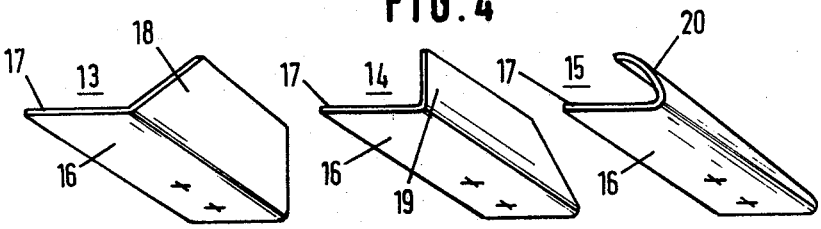
FIG. 6 shows three variant constructions of elements for a cutter.

Though the cutter can be manufactured in one piece, the cutter of the invention is composed of separate elements, of which FIG. 6 shows three variants 13, 14 and 15. Each element comprises a substantially flat parallelogram-shaped cutting element 16, of which an edge 17 each time defines part of the cutting edge of cutter 4, while an upright part 18, 19 or 20, connected to the cutting element, forms a guide vane. A number of these guide vanes is indicated by 10 in FIGS. 1 and 3. The intermediate cutting elements have no guide vane.

The vanes serve to guide the earth loosened with cutter 4 and to distribute the loosened earth in the water flow on several points, so that improved mixing and a higher slurry concentration can be realized, and to prevent the earth in the draghead from settling. Vane 18, mounted in the draghead, is substantially vertically directed. Vane 19 is directed substantially normal to the plane of the cutting element 16, while vane 20 is bent in the form of a plough blade, thus ensuring that the earth is first upwardly transported and then dropped into the transport water flow.

It is observed that the position of the blades of cutter 4 with respect to the bottom is preferably such as to enclose an angle of about 30°. A greater angle of the cutter will cause a great drag resistance. A small angle will cause little drag resistance, it is true, but especially in coherent earth the draghead will rapidly become clogged. An angle in the order of 25°–40° and a concentrated water flow running along or behind the cutter, parallel thereto, will cause the earth cuts to erode rapidly. This is even promoted when the slurry channel is disposed below and behind the top edge of the cutter. The earth cuts will break at the top edge of the cutter and fall into the slurry channel.

Instead of one V-shaped cutter it is, of course, also possible to use several cutters, possibly in superposed fashion and whether or not V-shaped. Neither is it necessary for the supply of water to take place in drag direction at the rear end of the draghead, insofar as the water flow is directed substantially parallel to the top edge of the cutter blades. It is advantageous to effect the slightest possible change of direction of the transport water in the draghead. Should the sealing between the shoe on the earth be insufficient in certain conditions, it is also possible to use vertical partitions or cutters penetrating into the earth. Besides, for the transport water it is not necessary to use water to be sucked from the surroundings, but use can also be made of a closed transport water circulation system, wherein the transport water is led back from, for instance, the cargo space of the trailing suction dredger to the draghead, whether or not using the pressure of a suction and pressure pump.

I claim:

1. A draghead including a connection opening for connection to a suction tube: at least one cutter mounted on the draghead and disposed to be dragged with a cutting edge through the earth to be sucked, the cutting having two legs arranged in a V-shape with the edge of the V facing in the drag direction and forming said cutting edge, a transport water tube provided along and substantially parallel to the rear edge of each leg and terminating into said connection opening for the suction tube, said water tubes being of reduced cross-section with respect to the cross-section of the suction tube and having open ends for receiving a supply of transport water.

2. A draghead as in claim 1 wherein the sum of the surface of the cross-sections of the two transport water tubes is substantially equal to the surface of the cross-section of the connection opening for the suction line.

3. A draghead including a casing having a connection opening for connection to a suction tube; at least one cutter mounted on the draghead and disposed to be dragged with a cutting edge through the earth to be sucked; a transport water tube of reduced cross-section with respect to the cross-section of the suction tube mounted in the draghead, said transport water tube having an open end for receiving a supply of transport water and terminating into the connection opening for the suction tube, and said transport water tube extending substantially parallel to the rear edge of the cutter; and ground-engaging shoes extending parallel to the cutter and serving to seal said transport water tube from the surrounding water when the draghead is in operation.

4. A draghead for removing earth from an underwater bottom comprising a cutter lying in generally a horizontal plane, said cutter having two cutting edges disposed in a generally horizontal plane and inclined toward each other in a forward direction, said cutting edges facing in a generally forward direction so that during forward movement of said draghead along an underwater bottom earth is loosened and lifted from the bottom by said cutting edge; a tubular suction connection having a lower open end disposed above the forwardmost portion of said cutter and on a line which bisects said cutting edges; means for passing a stream of transport water in the form of a powerful high-velocity jet substantially parallel to and along the upper edge of the cutter in an overall forward direction toward said tubular suction connection, said means including two water transport tubes arranged one above each of said cutting edges, said tubes having forward ends which communicate with said tubular suction connection and open rear ends for receiving a supply of transport water, each of said tubes being open to its respective cutting edge along substantially the length of the tube, whereby earth loosened and lifted by the cutter is formed into a slurry which is transported into said tubular suction connection.

5. A draghead as in claim 4 wherein the cross-sectional area of said tubular suction connection is substantially equal to the sum of the cross-sectional areas of said two transport tubes.

* * * * *